United States Patent [19]

Tsuzuki et al.

[11] 4,248,562

[45] Feb. 3, 1981

[54] COKE GUIDE CAR

[75] Inventors: Akira Tsuzuki, Yokohama; Hiroshi Tobitani, OazaKukisaki, both of Japan

[73] Assignee: Koritsu Kikai Kogyo Company Limited, Tokyo, Japan

[21] Appl. No.: 84,095

[22] Filed: Oct. 12, 1979

[51] Int. Cl.[3] ..... C10B 29/00; B65G 25/00

[52] U.S. Cl. ..... 414/212; 202/241; 414/401; 414/584

[58] Field of Search ..... 414/210, 212, 214, 215, 414/401, 396, 584; 202/241, 262; 104/88

[56] References Cited

U.S. PATENT DOCUMENTS

| | | | |
|---|---|---|---|
| 2,589,231 | 3/1952 | Drake | 414/215 |
| 3,436,316 | 4/1969 | Lorrek | 414/215 X |
| 3,520,425 | 7/1970 | Stender | 414/210 |
| 3,921,830 | 11/1975 | Bright | 414/215 |
| 4,026,768 | 5/1977 | Bahnsch et al. | 202/241 |

*Primary Examiner*—Robert B. Reeves
*Assistant Examiner*—Gene A. Church
*Attorney, Agent, or Firm*—Wills, Green & Mueth

[57] ABSTRACT

One cycle of operations for pushing-out of the coke, including door removal, jamb cleaning, coke guidance and reinstallation of the removed door can be conducted on one spot by employment of a common passage system for door extractor, jamb cleaner and coke guide cage, and of an automatic centering mechanism which allows the car to be positioned at once exactly in front of the coking chamber without necessity of highly skilled workman.

2 Claims, 8 Drawing Figures

COKE GUIDE CAR

BACKGROUND OF THE INVENTION

This invention relates to an improved coke guide car. With a conventional coke guide car which includes a coke guide cage, a door extractor and a jamb cleaner mounted movably to and fro on the floor of the chassis thereof, the car is moved to and stopped at the front of a desired coking chamber from which produced coke is just to be pushed out. However, it must be moved and stopped in order that the door extractor first be positioned exactly in front of the chamber to remove the door from the opening of the chamber. After the door extractor is moved back, the coke guide car is moved a little in order that the jamb cleaner now be positioned exactly in front of the chamber to clean the opening of the chamber, and after the jamb cleaner is moved back, the coke guide car is again moved a little in order to place the coke guide cage exactly in front of the chamber to receive and guide the pushed-out coke. Then, the coke guide car is moved again so that the door extractor is again positioned exactly in front of the chamber to reinstall the removed door.

As described above, with the conventional coke guide car three steps of minor movements of the coke guide car are required for one cycle of operation from removal to reinstallation of the door. Further, with conventional coke guide cars, in order to position the door extractor, jamb cleaner and the coke guide cage exactly in front of the chamber, a highly skilled workman is required, and in cases where such exact positioning is not obtained, there must be repeated minor movements of the coke guide car. This lengthens operating time considerably. Moreover, repeated minor movements of the coke guide car result in accelerated wear and tear of the car, particularly the driving mechanism thereof.

SUMMARY OF THE INVENTION

An object of this invention is to provide an improved coke guide car capable of conducting one cycle of operation including removal of the door, cleaning of the opening of the chamber, guidance of the pushed-out coke, and reinstallation of the removed door, at the very spot where the coke guide car once stopped to position the coke guide cage exactly in front of the chamber, without repeated minor movements of the car and prolonged working time.

Another object of this invention is to provide an improved coke guide car capable of being positioned exactly in front of the chamber by an automatic centering device thereof without the need of a skilled workman.

An improved coke guide car in accordance with this invention comprises carriage means mounted to a platform for movement therealong, a coke guide cage movable to and fro along a center passageway on the floor of the carriage means, a jamb cleaner and a door extractor juxtaposed on opposite sides of the carriage means and mounted on respective pivot means on the front portion of the carriage means, the pivot means being movable to and fro such that each of said jamb cleaner and door extractor is alternatively movable to and fro over the passageway of the coke guide cage when rotated to a predetermined orientation, and an automatic centering device mounted under the carriage means for stopping it at a desired location in alignment with the centerline of a coking chamber in association with a stopper block positioned on the platform, such that the guide car is capable of conducting one cycle of operation including door removal, jamb cleaning, guidance of pushed out coke and reinstallation of the removed door at the desired location without moving the carriage means.

Since the coke guide car of this invention is constructed as above, the car can be stopped exactly in front of the desired coking chamber without the need of a skilled workman and a complete cycle of operation can be conducted at one spot. Accordingly, working time can be shortened and wear to the driving system from repeated movements and stops of the car can be reduced.

BRIEF DESCRIPTION OF THE INVENTION

This invention will be illustrated in detail by way of example with reference to the accompanying drawings, in which.

DESCRIPTION OF THE PREFERRED EMBODIMENT

Figure 1:
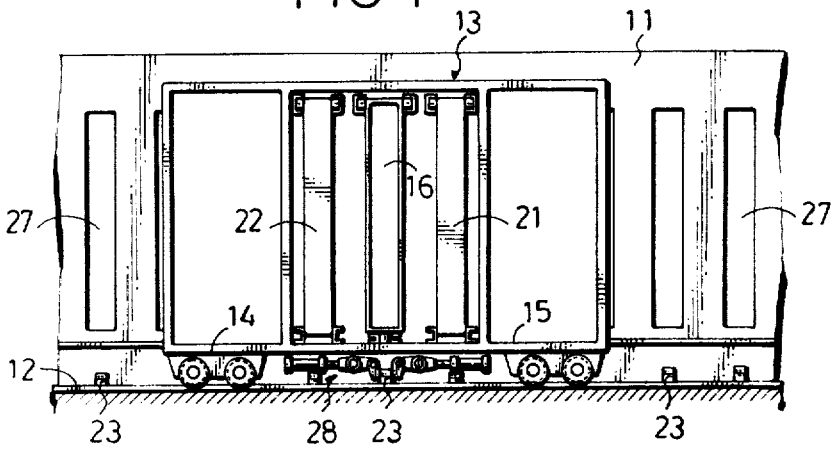
FIG. 1 is a front elevational view of a coke guide car constructed in accordance with the present invention and positioned in front of a battery of coking chambers.
Figure 2:
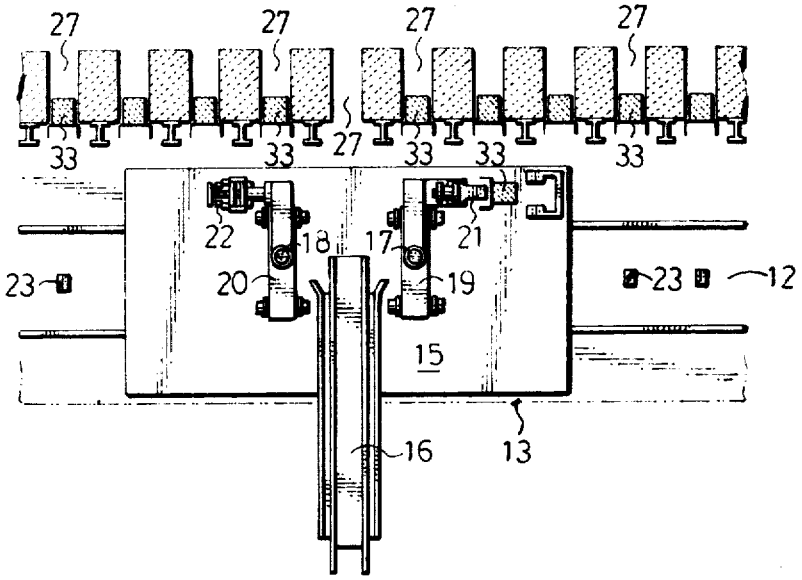
FIG. 2 is a top plan view of the same.

Referring now to FIGS. 1 and 2, on the coke side of a battery 11 of coking chambers 27, there is constructed a platform 12 on which a coke guide car 13 is arranged for right and left movement on rails (not identified) along the coking chamber 27. On the floor 15 of a chassis 14 is mounted a coke guide cage 16 movable to and fro. On one side of the coke guide cage 16 is juxtaposed a first holding carriage 19 which is per se movable to and fro on rails (not identified). On the front portion of the first holding carriage 19 is mounted a door extractor 21 rotatable toward the guide cage 16 around a pivot 17. On the other side of the coke guide cage 16 is juxtaposed a second holding carriage 20 which is per se movable to and fro on rails (not identified). On the front portion of the second holding carriage 20 is mounted a jamb cleaner 22 rotatable toward the guide cage 16 around a pivot 18.

Figure 8:
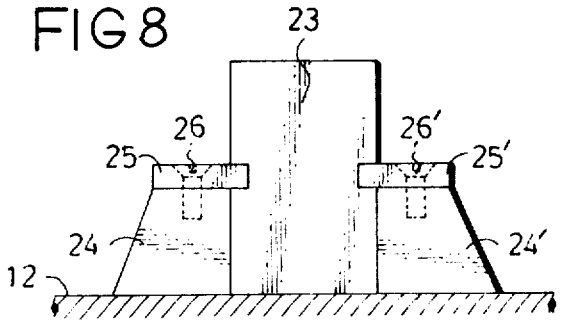
FIG. 8 is an enlarged front view of a stopper block.
Figure 3:
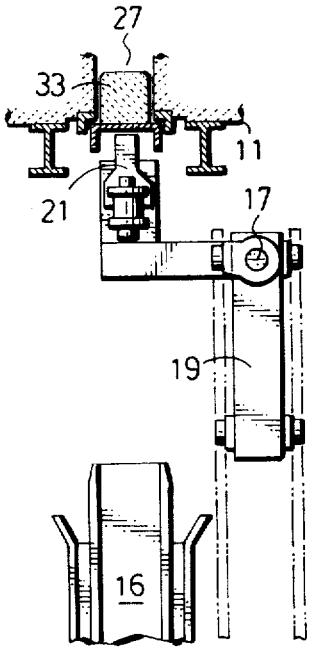
FIG. 3 is an enlarged plan view of a door extractor shown in a state frontwardly advanced.
Figure 4:
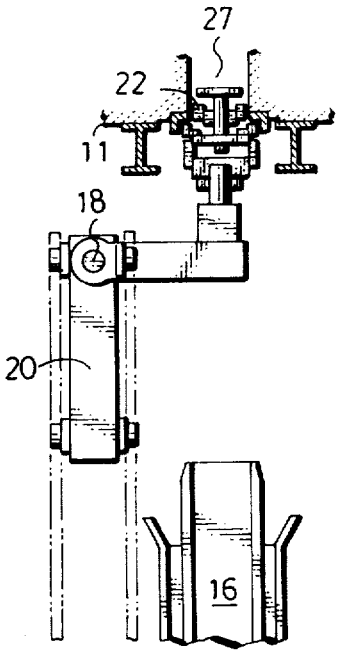
FIG. 4 is an enlarged plan view of a jamb cleaner shown in a state frontwardly advanced.

As shown in FIGS. 3 and 4, both the door extractor 21 and the jamb cleaner 22 can alternately be positioned in the path of the guide cage 16 when rotated toward the guide cage 16 by 90 degrees. As shown in FIGS. 1, 2 and 8, stopper blocks 23 are implanted on platform 12 in exact alignment with center lines (not shown) of the coking chambers 27. The stopper blocks are removably held by side walls 24 and 24', plates 25 and 25' and screws 26 and 26' on the platform 12. Under the chassis 14, an automatic centering device 28 is installed which comprises oppositely arranged hydraulic cylinders 29 and 29' with rods 30 and 30' extending inwards, and engaging stoppers 32 and 32' pivotable around pivots 31 and 31'. The pivotable stoppers 32 and 32' act to hold head portions of the stopper blocks 23 from both sides when the hydraulic cylinders are all actuated.

Figure 5:
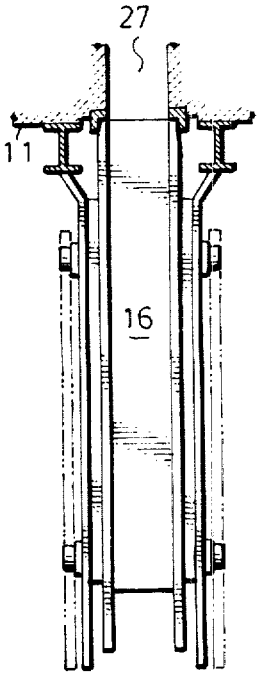
FIG. 5 is an enlarged plan view of a coke guide cage shown in a state frontwardly advanced.
Figure 6:
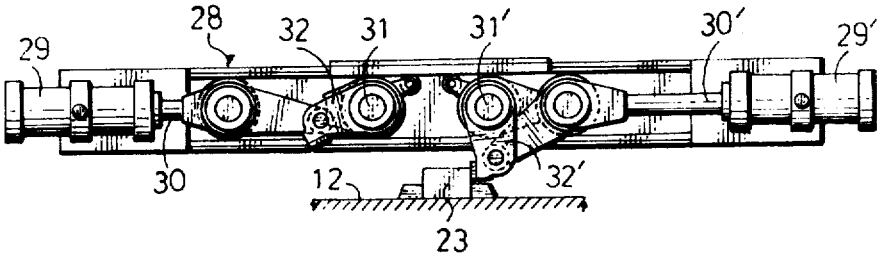
FIG. 6 is an enlarged front view of a centering stoppage device shown in a partially actuated condition.
Figure 7:
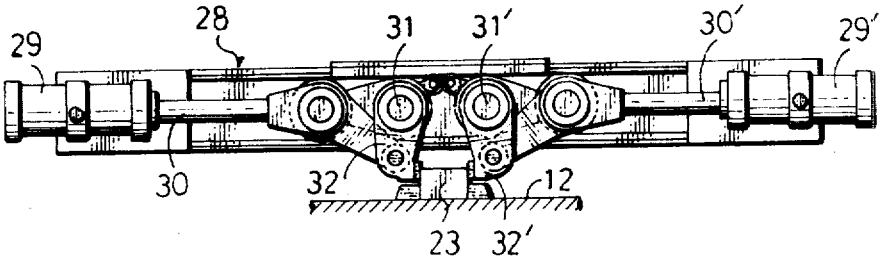
FIG. 7 is a similar view of the same shown in the fully actuated condition.

In operation, the coke guide car 13 is driven to the front of a desired coking chamber 27 from which produced cokes are to be pushed out and is stopped with the guide cage 16 positioned exactly in front of the chamber 27 in such a way as described below. When the guide car 13 has been stopped substantially in front of the coking chamber, one of the hydraulic cylinders 29 and 29', for example, the 29' of the automatic centering device 28, is first actuated through the rod 30' to close the associated pivotable stopper 32'. Thus, the stopper 32' abuts one side of the head portion of the stopper block 23. Likewise, the other cylinder 30 is then actuated to cause the pivotable stopper 32 to abut the other side of the head portion of the stopper block 23. By closing both stoppers 32 and 32' and abutting both sides of the head portions of the stopper block 23, the coke guide car is moved somewhat from its initial position by the stoppers 32 to locate the car exactly in front of the coking chamber 27. The coke guide cage 16 is then exactly aligned with the door 33. With the coke guide cage 16 moved fully rearward to open the front portion of the passageway of the coke guide cage, the door extractor 21 is first rotated by 90 degrees inward around the pivot 17 and advanced toward the chamber 27 in exact alignment therewith to remove the door 33 as shown in FIG. 3. After removal of the door 33 in the conventional manner, the door extractor 21 is moved back to its retracted condition and the jamb cleaner 22 is likewise advanced toward the chamber 27 for jamb cleaning operation. After the jamb cleaner 22 is returned to its retracted condition, the coke guide cage 16 is advanced toward the chamber 27 to receive and guide the pushed out coke as shown in FIG. 5. Upon completion of the pushing out of the coke, the guide cage 16 is retracted and the door extractor carrying the door 33 is advanced toward the chamber 27 to reinstall the door to the opening of the chamber.

As described above, in accordance with the present invention one complete cycle of operation for pushing-out of the coke can be conducted at a single location once the coke guide car 15 is moved to the position exactly in front of the chamber by operation of the automatic centering device. Accordingly, this results in shorter work time and prevention of wear and tear, particularly in the driving system of the coke guide car.

We claim:

1. A coke guide car arrangement comprising:

carriage means mountable to a platform for movement therealong;

a coke guide cage movable to and fro along a central path on the floor of the carriage means;

a jamb cleaner and a door extractor juxtaposed on opposite sides of the carriage means and mounted on respective pivot means on the front portion of the carriage means, the pivot means being movable to and fro such that each of said jamb cleaner and door extractor is alternatively movable to and fro along the path of the coke guide cage when rotated inwardly to a predetermined orientation; and an automatic centering device mounted under the carriage means for stopping the carriage means at a desired location in alignment with the centerline of a coking chamber in association with a stopper block positioned on the platform;

such that the guide car is capable of conducting one cycle of operation including door removal, jamb cleaning, guidance of pushed out coke and reinstallation of the removed door at said desired location without moving the carriage means.

2. The coke guide car arrangement recited in claim 1 in which the automatic centering device comprises a pair of hydraulic cylinders oppositely arranged with their rods extending inward, and a pair of pivotably mounted stoppers engaging the respective cylinder rods, the stoppers being actuable by the hydraulic cylinders to abut opposite sides of the head portion of the stopper block.

* * * * *